US011009224B2

(12) United States Patent
Ter Weeme et al.

(10) Patent No.: US 11,009,224 B2
(45) Date of Patent: May 18, 2021

(54) LIGHTING DEVICE

(71) Applicant: SIGNIFY HOLDING B.V., Eindhoven (NL)

(72) Inventors: Berend Jan Willem Ter Weeme, Eindhoven (NL); Bertrand Johan Edward Hontele, Breda (NL); Vincent Arnoud Wouters, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/574,053

(22) Filed: Sep. 17, 2019

(65) Prior Publication Data

US 2020/0096187 A1 Mar. 26, 2020

(30) Foreign Application Priority Data

Sep. 20, 2018 (EP) ..... 18195704

(51) Int. Cl.
*F21V 29/70* (2015.01)
*H05B 47/19* (2020.01)
*F21V 23/00* (2015.01)

(52) U.S. Cl.
CPC ..... *F21V 29/70* (2015.01); *F21V 23/004* (2013.01); *H05B 47/19* (2020.01)

(58) Field of Classification Search
CPC ..... F21V 29/70; F21V 23/004
See application file for complete search history.

(56) References Cited

U.S. PATENT DOCUMENTS

| | | | | |
|---|---|---|---|---|
| 8,013,545 | B2 | 4/2011 | Jonsson | |
| 9,184,497 | B2 | 11/2015 | Chen et al. | |
| 9,603,226 | B2 | 3/2017 | Sagal et al. | |
| 9,784,417 | B1 | 10/2017 | Springer | |
| 2010/0301365 | A1* | 12/2010 | Chuang | F21V 29/505 257/98 |
| 2014/0133153 | A1* | 5/2014 | Boomgaarden | F21K 9/232 362/294 |
| 2015/0103515 | A1 | 4/2015 | Bosua et al. | |

(Continued)

FOREIGN PATENT DOCUMENTS

| | | | |
|---|---|---|---|
| GB | 2526440 | A | 11/2015 |
| WO | 2013103698 | A1 | 7/2013 |

(Continued)

*Primary Examiner* — Evan P Dzierzynski
(74) *Attorney, Agent, or Firm* — Daniel J. Piotrowski

(57) ABSTRACT

A lighting device (1) is disclosed, comprising a carrier substrate (4) and a heat-transferring element (5). The carrier substrate (4) includes at least a first region (6) and a second region (8). The first region (6) comprises a light-emitting module (7). The second region (8) comprises a communication module (9), which is configured for wireless communication. The heat-transferring element (5) connected with the carrier substrate (4). The carrier substrate (4) partly overlies the heat-transferring element (5) such that at least a part or portion of the first region (6) of the carrier substrate (4) overlies the heat-transferring element (5) and at least a part or portion of the second region (8) of the carrier substrate (4) does not overlie the heat-transferring element (5).

13 Claims, 2 Drawing Sheets

(56) References Cited

U.S. PATENT DOCUMENTS

| | | | | |
|---|---|---|---|---|
| 2015/0276198 | A1* | 10/2015 | Hata | F21V 29/70 362/382 |
| 2016/0224173 | A1* | 8/2016 | Nakazawa | G06F 3/03547 |
| 2016/0330825 | A1* | 11/2016 | Recker | H05B 47/19 |

FOREIGN PATENT DOCUMENTS

| | | | |
|---|---|---|---|
| WO | 2015149605 | A1 | 10/2015 |
| WO | 2016146339 | A1 | 9/2016 |

* cited by examiner

LIGHTING DEVICE

TECHNICAL FIELD

The present invention relates to a lighting device having a component providing both light generating functionality and communication functionality.

BACKGROUND

Lamps or lighting modules with controllable light sources such as light-emitting diodes (LEDs) may be communicatively connected with a control unit or controller, e.g., in wireless fashion using radio frequency (RF) communication techniques or means. Such lamps or lighting modules will in the following be referred to as 'connected lamps', or 'connected LED lamps' in case of including one or more LEDs. As used herein, the term "LED lamp" encompasses LED modules or the like. While reference in the following may be made to connected LED lamp, it is to be understood that the description applies also to types of connected lamps other than connected LED lamps, similarly or in the same manner. RF communication techniques or means may for example employ or comprise one or more RF antennas. The operation of the light sources of the lamp may be controlled for example by means of the control unit or controller transmitting control signaling to the lamp. This may be particularly desirable for lamps capable of emitting light of different colors, such as, for example, multicolor filament lamps, in order to facilitate or allow for adjusting the color of the light emitted by the lamp. In alternative or in addition, dimming of the light source(s) of the lamp, or activation/deactivation of the light source(s) of the lamp, may be controlled (e.g., based on output from a sensor that may be included in the lamp) by means of the control unit or controller transmitting control signaling to the lamp.

In connected LED lamps, the light generating functionality (e.g., 'L2') and the communication functionality (e.g., an RF board) are provided in separate components. This is in part due to size constraints, but also because of the conflicting requirements of a wireless communication element (e.g., an antenna) and a light generating element (e.g., a LED board). For a good antenna performance, the antenna should be arranged distinct from and at a distance from metal parts of the connected LED lamp. However, for best thermal management performance (e.g., cooling) in connected LED lamp with a relatively high power, light-emitting elements such as LEDs should be placed on a metal core printed circuit board (MCPCB).

US 2015/103515 discloses a lighting assembly, comprising a circuit board coupled to a power storage unit, the circuit board comprising a processor and communication module; a lighting module electrically connected to the circuit board, the lighting module comprising: a substrate; and a set of light emitting elements mounted to a first broad face of the substrate.

SUMMARY

Due to the separation of the components providing the light generating functionality and the communication functionality, a relatively high number of connections (e.g., by means of wiring) may however be needed between the components providing the light generating functionality and the communication functionality (e.g., between a LED board and an RF board), respectively. This problem may become particularly pronounced in a multi-channel LED lamp, which may require about seven connections (e.g., by means of wiring) or more between the components providing the light generating functionality and the communication functionality. Another problem which may arise in connected LED lamps may be that it may be difficult to ensure a sufficiently large ground plane for an antenna providing communication functionality.

In view of the above discussion, a concern of the present invention is to reduce the number of required connections between components in a connected lamp providing light generating functionality and communication functionality.

To address at least one of this concern and other concerns, a lighting device in accordance with the independent claim is provided. Preferred embodiments are defined by the dependent claims.

According to a first aspect of the present invention, a lighting device is provided. The lighting device comprises a (or at least one) carrier substrate including at least a first region comprising a light-emitting module and a second region comprising a communication module configured for wireless communication. The lighting device comprises a (or at least one) heat-transferring element connected with the carrier substrate. The carrier substrate partly overlies the heat-transferring element such that at least a part or portion of the first region of the carrier substrate overlies the heat-transferring element and at least a part or portion of the second region of the carrier substrate does not overlie the heat-transferring element.

During operation, the light-emitting module may generate relatively much heat. By arranging the carrier substrate such that at least a part or portion of the first region of the carrier substrate—which region comprises the light-emitting module—overlies the heat-transferring element, a relatively high efficiency in thermal management of the light-emitting module may be achieved, since a relatively high amount of heat, or thermal energy, generated by the light-emitting module may be transported away from the light-emitting module by means of heat transfer from the light-emitting module via the heat-transferring element.

Further, by arranging the carrier substrate such that at least a part or portion of the second region of the carrier substrate—which region comprises the communication module—does not overlie the heat-transferring element, a relatively good wireless communication performance of the communication module may be achieved, since a wireless signal or signaling transmitted from or to the communication module may not be hindered, or only to a relatively small extent, by the heat-transferring element, due to the least a part or portion of the second region of the carrier substrate not overlying the heat-transferring element. That is to say, a wireless signal or signaling transmitted from or to the communication module may be relatively unaffected by the heat-transferring element.

The at least a part or portion of the second region of the carrier substrate that does not overlie the heat-transferring element may comprise at least the part(s) or portion(s) of the communication module that is or are configured to receive and/or transmit a wireless signal or signaling. The part(s) or portion(s) of the communication module that is or are configured to receive and/or transmit a wireless signal or signaling may comprise at least one antenna, such as, for example, at least one radio frequency (RF) antenna.

As mentioned above, the carrier substrate includes at least a first region comprising a light-emitting module and a second region comprising a communication module configured for wireless communication. Each of the light-emitting module and the communication module and/or any additional module of the carrier substrate may be integrally arranged in the carrier substrate. Thus, by arranging the carrier substrate such that at least a part or portion of the first region of the carrier substrate overlies the heat-transferring element and at least a part or portion of the second region of the carrier substrate does not overlie the heat-transferring element, light generating functionality and communication functionality can achieved on one carrier substrate while achieving both a relatively high efficiency in thermal management of the light-emitting module and a relatively good wireless communication performance of the communication module, while reducing or even eliminating need for separation of the components providing the light generating functionality and the communication functionality.

The carrier substrate may for example comprise at least one printed circuit board (PCB), such as, for example, at least one multilayer PCB. For example, the carrier substrate may comprise two or more PCBs interconnected by means of board-to-board connection(s), e.g., solder connection(s). The first region, comprising a light-emitting module, and the second region, comprising a communication module, may be in the same or in different ones of such two or more interconnected PCBs. In such a carrier substrate comprising two or more interconnected PCBs, there may for example be provided a metal core printed circuit board (MCPCB), which may be directly in contact with a heat spreader or the like, and a so called FR4 board, which may include the second region comprising the communication module, and which FR4 board may be directly soldered onto a side of the MCPCB. In alternative, or in addition, the carrier substrate may be flexible, and may for example comprise at least one flexible PCB and/or a flexible foil (e.g., 'flexfoil'). Such a carrier substrate may be configured to support at least one light-emitting element and provide power thereto (e.g., by way of one or more electrically conductive tracks or traces, as known in the art). In alternative, or in addition, the carrier substrate may for example comprise a multilayer substrate, such as, for example, a multilayer PCB or the like, and may for example include one or more electrically conductive tracks or traces on or in a layer of the multilayer substrate.

The carrier substrate may comprise a first side, and possibly a second side, which may be opposite to the first side. That is to say, the first and second sides may be opposite sides of the carrier substrate.

The first region and the second region of the carrier substrate may be adjoining, or contiguous, regions, or they may be separated by some other region of the carrier substrate arranged intermediate the first region and the second region, for example.

The carrier substrate may include one or more additional regions, such as, for example, a third region, which for example may comprise a connectivity module configured to connect the carrier substrate with some other entity (e.g., a component or a device), e.g., via a connectivity module thereof. Each of the light-emitting module and the communication module and/or any additional module of the carrier substrate may be integrally arranged in the carrier substrate. The first region and the second region and any additional region of the carrier substrate may be adjoining, or contiguous, regions, or at least two of the regions may be separated by some other region of the carrier substrate arranged intermediate the two regions, for example. As mentioned in the foregoing, the carrier substrate may for example comprise two or more PCBs interconnected by means of board-to-board connection(s), e.g., solder connection(s). The first region, comprising a light-emitting module, and the second region, comprising a communication module, may be in the same PCB or in different PCBs of such two or more interconnected PCBs. Thus, by the light-emitting module and the communication module and/or any additional module of the carrier substrate possibly being integrally arranged in the carrier substrate, it is not necessarily meant that the light-emitting module and the communication module and/or any additional module are in the same PCB (but they could be), but they may be in different ones of such two or more interconnected PCBs.

The carrier substrate may be provided with a ground plane, for example at one side of the carrier substrate. The ground plane may be a part or portion of the at least one carrier substrate. For example, the carrier substrate may comprise multiple parts, one which may be the ground plane. The ground plane may for example comprise a metal plate, for example made of copper. The ground plane may be arranged so as to provide a heat spreading or transferring functionality or capability. To that end, the ground plane may be configured so that it has a relatively large thickness.

The heat-transferring element may comprise a heat spreader and/or a heatsink, for example. The heat-transferring element may be made at least in part by a material including or being constituted by one or more metals or metal alloys. For example, the heat-transferring element may be made of aluminum (Al). The heat-transferring element may have the form of a plate, or may be at least in part shaped like a plate, but it is not limited to such a shape. The heat-transferring element may for example comprise, or be comprised in, a metal core printed circuit board (MCPCB).

In the context of the present application, by wireless communication it is meant in principle any type of communication by means of one or more links, connections or couplings utilizing one or more wireless techniques or means for effecting communication, such, as for example, at least one radio frequency (RF) communication link. The wireless communication is not limited thereto, however, and could in alternative or in addition mean communication by means of an infrared communication link (e.g., a communication link employing infrared light) or another type of free-space optical communication link (e.g., based on laser).

The light-emitting module may be configured to emit light when operated or activated. The light-emitting module may comprise at least one light-emitting element, which may be supported by the carrier substrate, e.g., at one side thereof. Each or any one of the at least one light-emitting element may for example include or be constituted by a solid state light emitter. Examples of solid state light emitters include light-emitting diodes (LEDs) and organic LEDs (OLEDs). Solid state light emitters are relatively cost efficient light sources since they in general are relatively inexpensive and have a relatively high optical efficiency and a relatively long lifetime. However, in the context of the present application, the term "light-emitting element" should be understood to mean substantially any device or element that is capable of emitting radiation in any region or combination of regions of the electromagnetic spectrum, for example the visible region, the infrared region, and/or the ultraviolet region, when activated e.g. by applying a potential difference across it or passing a current through it. Therefore, a light-emitting element can have monochromatic, quasi-monochromatic, polychromatic or broadband spectral emission characteristics. Examples of light-emitting elements include semiconductor, organic, or polymer/polymeric LEDs, violet LEDs, blue LEDs, optically pumped phosphor coated LEDs, optically pumped nano-crystal LEDs or any other similar devices as would be readily understood by a person skilled in the art. Furthermore, the term light-emitting element can, according to one or more embodiments of the present invention, mean a combination of the specific light-emitting element(s) which emit the radiation in combination with a housing or package within which the specific light-emitting element(s) is positioned or arranged. For example, the term light-emitting element or light-emitting module can encompass a bare LED die arranged in a housing, which may be referred to as a LED package. According to another example, the light-emitting element may comprise a Chip Scale Package (CSP) LED, which may comprise a LED die directly attached to a substrate such as a PCB, and not via a sub-mount.

The lighting device may for example be included in or constitute a LED bulb or retrofit lamp which is connectable to a lamp or luminaire socket by way of some appropriate connector, for example an Edison screw base, a bayonet fitting, or another type of connection suitable for the lamp or luminaire known in the art. The lighting device may for example comprise a base for connection to a lamp socket. The base may include or be constituted by any suitable type of connector, for example an Edison screw base, a bayonet fitting, or another type of connection.

The lighting device may include circuitry capable of converting electricity from a power supply to electricity suitable to operate or drive the at least one light-emitting element. The circuitry may be capable of at least converting between Alternating Current and Direct Current and converting voltage into a suitable voltage for operating or driving components of the lighting device, such as the light-emitting module.

The lighting device may include other electrical and electronic functionalities. Examples of such are, protection circuits, color regulation circuits, diming circuits, cut-off circuits, monitoring and temperature limiting circuits, wired communication circuits. By such wired communication circuits and/or the communication module, the light emitted by lighting device may be controlled with respect to, e.g., brightness and/or color, or for providing any other functionality such as, for example, coded light.

As mentioned in the foregoing, the carrier substrate partly overlies the heat-transferring element such that at least a part or portion of the first region of the carrier substrate overlies the heat-transferring element, and at least a part or portion of the second region of the carrier substrate does not overlie the heat-transferring element. Further, the second region of the carrier substrate comprises a communication module configured for wireless communication. In accordance with one or more embodiments of the present invention, the carrier substrate may partly overlie the heat-transferring element in such a way that the communication module of the carrier substrate does not overlie the heat-transferring element. Stated in another way, the part or portion of the second region of the carrier substrate which may be constituted by the communication module may not overlie the heat-transferring element. By arranging the carrier substrate such that the communication module does not overlie the heat-transferring element, a relatively good wireless communication performance of the communication module may be achieved, since a wireless signal or signaling transmitted from or to the communication module may be hindered only to a relatively small extent, or possibly not at all, by the heat-transferring element.

The carrier substrate may have a surface facing the heat-transferring element. The at least one part or portion of the first region of the carrier substrate overlying the heat-transferring element may be connected via the surface to the heat-transferring element. The at least a part or portion of the second region of the carrier substrate not overlying the heat-transferring element may not be connected via the surface to the heat-transferring element. By connecting the at least one part or portion of the first region of the carrier substrate overlying the heat-transferring element to the heat-transferring element, heat transfer from the first region of the carrier substrate to the heat-transferring element may be facilitated, e.g., transfer of heat generated by the light-emitting module to the heat-transferring element. Any suitable means for connecting the at least one part or portion of the first region of the carrier substrate overlying the heat-transferring element to the heat-transferring element, e.g., via the surface, may be employed. Such means may for example include glue, such as, for example, a thermally conductive glue such as thermal adhesive. According to one or more embodiments of the present invention, the heat-transferring element may be connected with the carrier substrate via the surface only at the at least one part or portion of the first region of the carrier substrate overlying the heat-transferring element.

The carrier substrate and/or the heat-transferring element may be arranged in different manners so as to achieve that the carrier substrate partly overlies the heat-transferring element such that at least a part or portion of the first region of the carrier substrate overlies the heat-transferring element and at least a part or portion of the second region of the carrier substrate does not overlie the heat-transferring element.

For example, the heat-transferring element may comprise at least one cut-out portion arranged in relation to the carrier substrate, or vice versa, such that the at least a part or portion of the second region of the carrier substrate does not overlie the heat-transferring element. Stated in another way, the heat-transferring element may comprise at least one cut-out portion which, when the carrier substrate partly overlies the heat-transferring element, may correspond to the at least a part or portion of the second region of the carrier substrate. In that way, when the carrier substrate partly overlies the heat-transferring element, the at least a part or portion of the second region of the carrier substrate may be arranged above (or beneath) one or more cut-out portions of the heat-transferring element. Thereby, the at least a part or portion of the second region of the carrier substrate may not overlie the heat-transferring element.

In the context of the present application, by a cut-out portion of (or in) the heat-transferring element, it is not necessarily meant a part or portion of the heat-transferring element that has been removed from the heat-transferring element by an act of cutting (but it may be). A cut-out portion of (or in) the heat-transferring element can in the context of the present application be considered as descriptive of the form or shape of the heat-transferring element in relation to the carrier substrate, wherein the cut-out portion allows the heat-transferring element to be arranged in relation to the carrier substrate such that when the carrier substrate partly overlies the heat-transferring element, the cut-out portion corresponds with, or matches, or is aligned with, the at least a part or portion of the second region of the carrier substrate, whereby the at least a part or portion of the second region of the carrier substrate may not overlie the heat-transferring element.

The heat-transferring element may have a surface facing the carrier substrate. The surface may have a perimeter at least in part defining an edge of the heat-transferring element. The at least one cut-out portion may form a part of the edge of the heat-transferring element. Thus, one or more cut-out portions of the heat-transferring element may be situated at an edge thereof. The heat-transferring element may for example be in the shape of plate, and one or more cut-out portions may then be situated at the edge of the plate-shaped heat-transferring element. In alternative or in addition, (the) at least one cut-out portion may be extending within the perimeter, but without extending to the edge. That is to say, (the) at least one cut-out portion may be situated away from, i.e. at a distance from, the edge.

In alternative, or in addition, a part or portion of the carrier substrate may be bent away from the heat-transferring element in such a way that the at least a part or portion of the second region of the carrier substrate does not overlie the heat-transferring element. Such bending of the carrier substrate may be facilitated by employing a carrier substrate which is flexible. Possibly, a part or portion of the carrier substrate may be bent so as to make it more compact and take up less space in the lighting device, e.g., by wrapping a part or portion of the carrier substrate around some component of the lighting device, such as, for example, around driver circuitry for controlling operation of the lighting module.

In alternative, or in addition, the at least a part or portion of the second region of the carrier substrate not overlying the heat-transferring element may be 'non-overlapping' with the heat-transferring element. The heat-transferring element may have a surface facing the carrier substrate. The surface facing the carrier substrate may be facing a surface of the carrier substrate at least where the carrier substrate overlies the heat-transferring element. The surface may have a perimeter at least in part defining an edge of the heat-transferring element. The carrier substrate may be arranged in relation to the heat-transferring element such that at least a part or portion of the carrier substrate extends outside (or beyond) the perimeter so as to not overlie the heat-transferring element.

The communication module may for example comprise at least one antenna, such as, for example, at least one radio frequency (RF) antenna.

The carrier substrate may comprise a ground plane. The ground plane of the carrier substrate may be configured to be employed as a ground plane for the at least one (RF) antenna. The ground plane may for example comprise a metal plate or one or more metal traces arranged on a surface of the carrier substrate, with the metal plate and/or metal trace(s) for example being made of copper. Thus, the at least one antenna may be integrated in or on the carrier substrate, e.g., by means of a metal plate or one or more metal traces arranged on a surface of the carrier substrate. As mentioned, the carrier substrate may for example comprise at least one printed circuit board (PCB). The ground plane of the carrier substrate may for example comprise, or be constituted by, a ground plane of the at least one PCB.

The lighting device may comprise a housing, which may be arranged to at least in part enclose the carrier substrate and the heat-transferring element. The ground plane of the carrier substrate may be connected to the housing. By the ground plane of the carrier substrate being connected to the housing, the ground plane may facilitate heat transfer from the first region of the carrier substrate to the heat-transferring element, e.g., facilitate transfer of heat generated by the light-emitting module to the heat-transferring element. Such heat transfer may be further facilitated if the ground plane comprises or is constituted by a part or portion made of a material having a relatively high thermal conductivity, such as copper and/or another metal. By way of the ground plane of the carrier substrate being connected to the housing, additional thermal management component(s) such as any heat spreader(s) connected to the heat-transferring element may not be required in order to achieve a desired or required efficiency in thermal management of the light-emitting module.

Further objects and advantages of the present invention are described in the following by means of exemplifying embodiments. It is noted that the present invention relates to all possible combinations of features recited in the claims. Further features of, and advantages with, the present invention will become apparent when studying the appended claims and the description herein. Those skilled in the art realize that different features of the present invention can be combined to create embodiments other than those described herein.

BRIEF DESCRIPTION OF THE DRAWINGS

Exemplifying embodiments of the invention will be described below with reference to the accompanying drawings.

Figure 1:
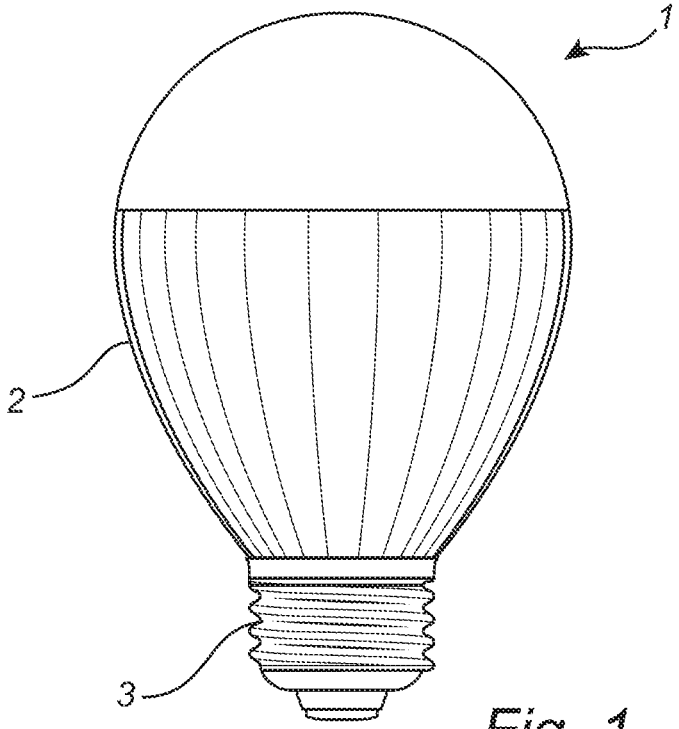
FIG. 1 is a schematic view of a lighting device according to an embodiment of the present invention.

All the figures are schematic, not necessarily to scale, and generally only show parts which are necessary in order to elucidate embodiments of the present invention, wherein other parts may be omitted or merely suggested.

DETAILED DESCRIPTION

The present invention will now be described hereinafter with reference to the accompanying drawings, in which exemplifying embodiments of the present invention are shown. The present invention may, however, be embodied in many different forms and should not be construed as limited to the embodiments of the present invention set forth herein; rather, these embodiments of the present invention are provided by way of example so that this disclosure will convey the scope of the invention to those skilled in the art. In the drawings, identical reference numerals denote the same or similar components having a same or similar function, unless specifically stated otherwise.

FIG. 1 is a schematic view of a lighting device 1 according to an embodiment of the present invention. The lighting device 1 comprises a housing 2, which in accordance with the illustrated embodiment of the present invention includes light-transmissive envelope. The light-transmissive envelope may at least in part define an enclosed space. The light-transmissive envelope may be configured such that the space is a fluidly sealed space, which space may include or be filled for example with air or a thermally conductive fluid, for example a gas including helium and/or hydrogen, or a mixture of gases including for example helium, oxygen and/or air. The shape of the housing 2 illustrated in FIG. 1 is according to an example. Other shapes of the housing 2 are possible, and the housing 2 may in principle have any shape. In accordance with the embodiment of the present invention illustrated in FIG. 1, the lighting device 1 may comprise a base 3 for connection to a lamp or luminaire socket (not shown in FIG. 1). The base 3 may include or be constituted by any suitable type of coupler or connector, for example an Edison screw base, a bayonet fitting, or any other type of connection which may be suitable for the particular type of lamp or luminaire.

While a particular type of the lighting device 1 is illustrated in FIG. 1, it is to be understood that the type of the lighting device 1 illustrated in FIG. 1 is exemplifying and not limiting, and that the lighting device 1 may be of another type than illustrated in FIG. 1.

The lighting device 1 comprises a carrier substrate and a heat-transferring element, which will be described further in the following with reference to FIGS. 2 and 3. In accordance with the embodiment of the present invention illustrated in FIG. 1, the carrier substrate and the heat-transferring element are arranged inside the housing 2 and/or inside the base 3, which also may be considered as a housing, wherein the housing 2 and/or the base 3 at least in part enclose the carrier substrate and the heat-transferring element. As will be further described in the following, the carrier substrate comprises a light-emitting module, which may emit light that subsequently may exit the lighting device 1 via the light-transmissive envelope.

Figure 2:
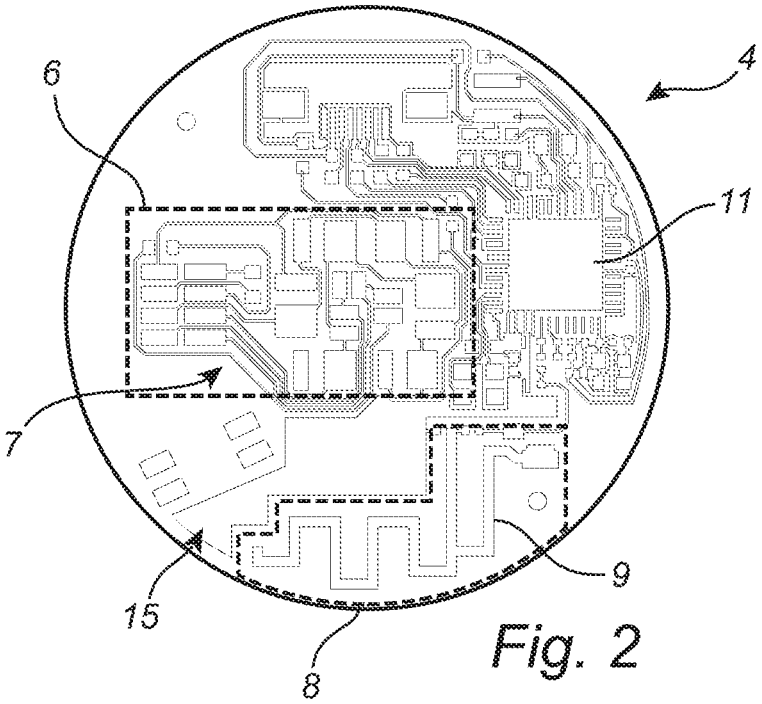
FIG. 2 is a schematic view of a carrier substrate in accordance with an embodiment of the present invention.

FIG. 2 is a schematic view of a carrier substrate 4 in accordance with an embodiment of the present invention. FIG. 3 is a schematic view of a heat-transferring element 5 in accordance with an embodiment of the present invention.

In an assembled state of the lighting device 1, the heat-transferring element 5 is connected with the carrier substrate 4. FIGS. 2 and 3 illustrate the carrier substrate 4 and the heat-transferring element 5, respectively, not being connected with each other.

With reference to FIG. 2, the carrier substrate 4 includes a first region, schematically indicated at 6, which first region 6 comprises a light-emitting module, schematically indicated at 7. The carrier substrate 4 may for example comprise at least one printed circuit board (PCB), such as, for example, at least one flexible PCB and/or a flexible foil (e.g., 'flexfoil'). The carrier substrate 4 may for example comprise two or more PCBs interconnected by means of board-to-board connection(s), which for example may be achieved by soldering together the PCBs. The carrier substrate 4 is configured to support a plurality of light-emitting elements comprised in the light-emitting module 7, e.g., at one side of the carrier substrate 4, and may provide power to the light-emitting module 7 or the light-emitting elements (e.g., by way of one or more electrically conductive tracks or traces, as known in the art). The light-emitting module 7 may be configured to emit light when operated or activated. According to the embodiment of the present invention illustrated in FIG. 2, the light-emitting elements comprises LEDs and/or other types of solid state light emitters.

The carrier substrate 4 includes a second region, schematically indicated at 8, comprising a communication module, schematically indicated at 9, which is configured for wireless communication. In accordance with the embodiment of the present invention illustrated in FIG. 2, the communication module 9 comprises a radio frequency (RF) antenna 9, although it may, in alternative or in addition, comprise some other wireless communication means. Possibly, the communication module 9 may comprise more than one antenna (e.g., RF antennas).

As indicated in FIG. 2, the carrier substrate 4 may comprise a first side, at which the light-emitting module 7 and the communication module 9 are arranged, and possibly a second side that may be opposite to the first side. That is to say, the first and second sides may be opposite sides of the carrier substrate 4.

The carrier substrate 4 may include one or more additional regions, such as, for example, a third region, which third region for example may comprise a connectivity module, schematically indicated at 11. The connectivity module 11 may be configured to connect the carrier substrate 4 with some other entity (e.g., a component or a device), for example via a connectivity module of that other entity (not shown in FIG. 2).

In accordance with the embodiment of the present invention illustrated in FIG. 2, each of the light-emitting module 7, the communication module 9 and the connectivity module 11 is integrally arranged in the carrier substrate 4.

As mentioned in the foregoing, the lighting device 1 comprises a heat-transferring element 5 which in an assembled state of the lighting device 1 is connected with the carrier substrate 4. FIG. 3 illustrates the heat-transferring element 5 not being connected with the carrier substrate 4, in a non-assembled state of the lighting device 1. A connection between the heat-transferring element 5 and the carrier substrate 4 may for example be achieved by means of a glue connection, employing glue, such as, for example, a thermally conductive glue such as thermal adhesive.

Figure 3:
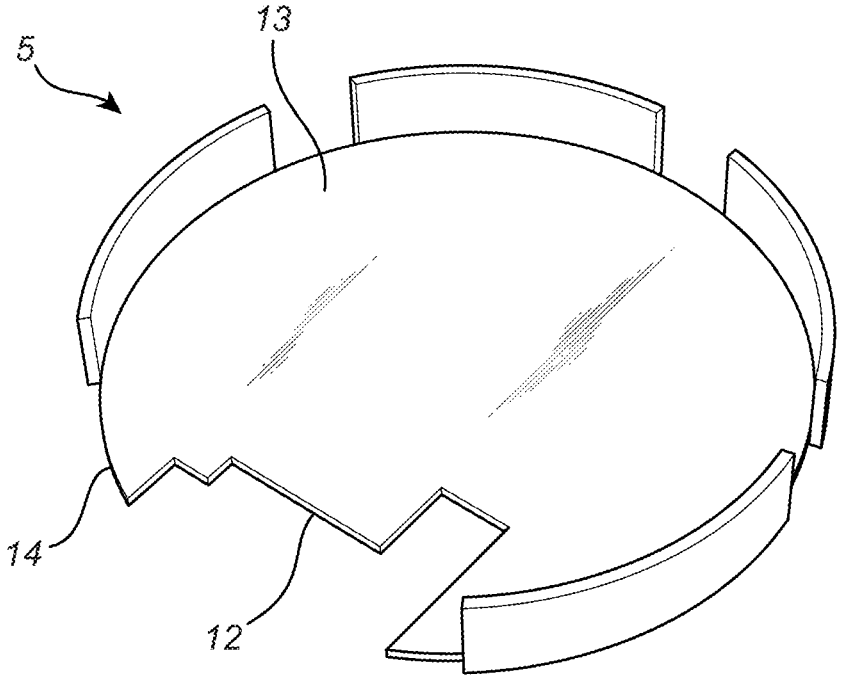
FIG. 3 is a schematic view of a heat-transferring element in accordance with an embodiment of the present invention.

With reference to FIGS. 2 and 3, when the heat-transferring element 5 is connected with the carrier substrate 4 (e.g., in an assembled state of the lighting device 1), the carrier substrate 4 partly overlies the heat-transferring element 5 such that at least a part or portion of the first region 6 of the carrier substrate 4 overlies the heat-transferring element 5, and at least a part or portion of the second region 8 of the carrier substrate 4 does not overlie the heat-transferring element 5. In accordance with the embodiment of the present invention illustrated in FIGS. 2 and 3, this may be achieved by way of the heat-transferring element 5 comprising a cut-out portion 12.

When the heat-transferring element 5 is connected with the carrier substrate 4 (e.g., in an assembled state of the lighting device 1), the cut-out portion 12 is arranged in relation to the carrier substrate 4 (or vice versa) such that the at least a part or portion of the second region 8 of the carrier substrate 4 does not overlie the heat-transferring element 5. Stated in another way, the heat-transferring element 5 comprises a cut-out portion 12 which, when the carrier substrate 4 partly overlies the heat-transferring element 5, corresponds, or substantially corresponds, to the at least a part or portion of the second region 8 of the carrier substrate 4. In that way, when the carrier substrate 4 partly overlies the heat-transferring element 5, the at least a part or portion of the second region 8 of the carrier substrate 4 may be arranged above (or beneath) the cut-out portion 12 of the heat-transferring element 5. Thereby, the at least a part or portion of the second region 8 of the carrier substrate 4 will not overlie the heat-transferring element 5.

The carrier substrate 4 and the heat-transferring element 5 may be arranged so as to be approximately matched in size and/or dimension. As illustrated in FIGS. 2 and 3, the carrier substrate 4 and the heat-transferring element 5 may be generally circular, for example. When the heat-transferring element 5 is connected with the carrier substrate 4 (e.g., in an assembled state of the lighting device 1), the carrier substrate 4 may be arranged above the heat-transferring element 5, wherein the shape and/or size of the cut-out portion 12 of the heat-transferring element 5 corresponds, or substantially corresponds, to the shape and/or size of the second region 8 of the carrier substrate 4, or at least a portion of the region 8 that includes the communication module, or antenna, 9. As seen in FIG. 2 and when compared with FIG. 3, the shape and size of the cut-out portion 12 of the heat-transferring element 5 corresponds to the shape and size of the second region 8 of the carrier substrate 4, such that when carrier substrate 4 is arranged above the heat-transferring element 5 when the heat-transferring element 5 is connected with the carrier substrate 4 (e.g., in an assembled state of the lighting device 1), the carrier substrate 4 partly overlies the heat-transferring element 5 such that at least a part or portion of the first region 6 of the carrier substrate 4 overlies the heat-transferring element 5, and at least a part or portion of the second region 8 of the carrier substrate 4 does not overlie the heat-transferring element 5.

The heat-transferring element 5 has a surface 13 facing the carrier substrate 4 when the heat-transferring element 5 is connected with the carrier substrate 4 (e.g., in an assembled state of the lighting device 1). The surface 13 has a perimeter 14 at least in part defining an edge of the heat-transferring element 5. As illustrated in FIG. 3, the cut-out portion 12 of the heat-transferring element 5 may form a part of the edge of the heat-transferring element 5. In alternative or in addition, the cut-out portion 12 (or another cut-out portion of the heat-transferring element 5) may be extending within the perimeter 14, but without extending to the edge, i.e. be situated away from, at a distance from, the edge.

It is to be understood that the heat-transferring element 5 and/or the carrier substrate 4 may be arranged in different manners so as to achieve that the carrier substrate 4 partly overlies the heat-transferring element 5 such that at least a part or portion of the first region 6 of the carrier substrate 4 overlies the heat-transferring element 5 and at least a part or portion of the second region 8 of the carrier substrate 4 does not overlie the heat-transferring element 5. Thus, the arrangement of the heat-transferring element 5 in relation to the carrier substrate 4 indicated in FIGS. 2 and 3 and as described in the foregoing is exemplifying but not limiting. For example, the carrier substrate 4 may be arranged in relation to the heat-transferring element 5 such that at least a part or portion of the carrier substrate 4 extends outside the perimeter 14 so as to not overlie the heat-transferring element 5. According to another example, a part or portion of the carrier substrate 4 may be bent away from the heat-transferring element 5 such that the at least a part or portion of the second region 8 of the carrier substrate 4 does not overlie the heat-transferring element 5.

The carrier substrate 4 may comprise a ground plane, which is schematically indicated at 15. The ground plane 15 of the carrier substrate 4 may be configured to be employed as a ground plane for the at least one (RF) antenna 9. The ground plane 15 may for example comprise a metal plate or one or more metal traces arranged on a surface of the carrier substrate 4, with the metal plate and/or metal trace(s) for example being made of copper. Thus, the RF antenna 9 may be integrated in or on the carrier substrate 4, e.g., by means of a metal plate or one or more metal traces arranged on a surface of the carrier substrate 4. As mentioned, the carrier substrate 4 may for example comprise at least one PCB, such as, for example, at least one flexible PCB. The ground plane 15 of the carrier substrate 4 may for example comprise, or be constituted by, a ground plane of the PCB.

In conclusion, a lighting device comprises a carrier substrate and a heat-transferring element. The carrier substrate includes at least a first region and a second region. The first region comprises a light-emitting module. The second region comprises a communication module, which is configured for wireless communication. The heat-transferring element connected with the carrier substrate. The carrier substrate partly overlies the heat-transferring element such that at least a part or portion of the first region of the carrier substrate overlies the heat-transferring element and at least a part or portion of the second region of the carrier substrate does not overlie the heat-transferring element.

While the present invention has been illustrated in the appended drawings and the foregoing description, such illustration is to be considered illustrative or exemplifying and not restrictive; the present invention is not limited to the disclosed embodiments. Other variations to the disclosed embodiments can be understood and effected by those skilled in the art in practicing the claimed invention, from a study of the drawings, the disclosure, and the appended claims. In the appended claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A lighting device comprising:

a carrier substrate including at least a first region comprising a light-emitting module and a second region comprising a communication module configured for wireless communication; and a heat-transferring element connected with the carrier substrate, wherein the carrier substrate partly overlies the heat-transferring element such that at least a part or portion of the first region of the carrier substrate overlies the heat-transferring element and at least a part or portion of the second region of the carrier substrate does not overlie the heat-transferring element, wherein the carrier substrate is flexible, and wherein the carrier substrate is bent to form the at least part or portion of the second region of the carrier substrate that does not overlie the heat-transferring element.

2. A lighting device according to claim 1, wherein the carrier substrate partly overlies the heat-transferring element such that the communication module of the carrier substrate does not overlie the heat-transferring element.

3. A lighting device according to claim 1, wherein the carrier substrate has a surface facing the heat-transferring element, and wherein the at least one part or portion of the first region of the carrier substrate overlying the heat-transferring element is connected via the surface to the heat-transferring element, and wherein the at least a part or portion of the second region of the carrier substrate not overlying the heat-transferring element is not connected via the surface to the heat-transferring element.

4. A lighting device according to claim 1, wherein the heat-transferring element is connected with the carrier substrate via the surface only at the at least one part or portion of the first region of the carrier substrate overlying the heat-transferring element.

5. A lighting device according to claim 1, wherein a part or portion of the carrier substrate is bent away from the heat-transferring element such that the at least a part or portion of the second region of the carrier substrate does not overlie the heat-transferring element.

6. A lighting device according to claim 1, wherein the heat-transferring element has a surface facing the carrier substrate, wherein the surface has a perimeter at least in part defining an edge of the heat-transferring element, and wherein the carrier substrate is arranged in relation to the heat-transferring element such that at least a part or portion of the carrier substrate extends outside the perimeter so as to not overlie the heat-transferring element.

7. A lighting device according to claim 1, wherein each of the light-emitting module and the communication module is integrally arranged in the carrier substrate.

8. A lighting device according to claim 1, wherein the communication module comprises at least one radio frequency, RF, antenna.

9. A lighting device according to claim 1, wherein the communication module comprises at least one radio frequency, RF, antenna and the carrier substrate comprises a ground plane, wherein the ground plane of the carrier substrate is configured to be employed as a ground plane for the at least one RF antenna.

10. A lighting device according to claim 9, wherein the carrier substrate comprises at least one printed circuit board, PCB, and wherein the ground plane of the carrier substrate is a ground plane of the at least one PCB.

11. A lighting device according to claim 9, further comprising a housing arranged to at least in part enclose the carrier substrate and the heat-transferring element, wherein the ground plane is connected to the housing.

12. A lighting device comprising:

a carrier substrate including at least a first region comprising a light-emitting module and a second region comprising a communication module configured for wireless communication; and a heat-transferring element connected with the carrier substrate, wherein the carrier substrate partly overlies the heat-transferring element such that at least a part or portion of the first region of the carrier substrate overlies the heat-transferring element and at least a part or portion of the second region of the carrier substrate does not overlie the heat-transferring element, wherein the carrier substrate is flexible, wherein the heat-transferring element comprises at least one cut-out portion arranged in relation to the carrier substrate, or vice versa, such that the at least a part or portion of the second region of the carrier substrate does not overlie the heat-transferring element; and wherein the heat-transferring element has a surface facing the carrier substrate, wherein the surface has a perimeter at least in part defining an edge of the heat-transferring element, and wherein the at least one cut-out portion is extending within the perimeter but without extending to the edge.

13. A lighting device according to claim 12, wherein the heat-transferring element has a surface facing the carrier substrate, wherein the surface has a perimeter at least in part defining an edge of the heat-transferring element, and wherein the at least one cut-out portion forms a part of the edge of the heat-transferring element.

* * * * *